US006463245B1

(12) United States Patent
Suwa et al.

(10) Patent No.: US 6,463,245 B1
(45) Date of Patent: Oct. 8, 2002

(54) DEVELOPING APPARATUS WITH A DC ELECTRIC FIELD FORMED BETWEEN A DEVELOPER CARRYING MEMBER AND A DEVELOPER REGULATING MEMBER AND IMAGE FORMING APPARATUS USING THE SAME

(75) Inventors: Koichi Suwa, Kawasaki; Yasushi Shimizu, Toride; Hiroshi Sato, Moriya-machi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/658,460

(22) Filed: Sep. 8, 2000

(30) Foreign Application Priority Data

Sep. 13, 1999 (JP) ..... 11-258982

(51) Int. Cl.[7] ..... G03G 15/08; G03G 15/09
(52) U.S. Cl. ..... 399/274; 399/284
(58) Field of Search ..... 399/274, 284

(56) References Cited

U.S. PATENT DOCUMENTS 4,564,285 A * 1/1986 Yasuda et al. ..... 399/274 X
5,170,213 A * 12/1992 Yamaguchi et al. .... 399/284 X
5,438,395 A 8/1995 Koga et al. ..... 355/253
5,519,472 A * 5/1996 Ojima et al. ..... 399/274
5,682,585 A 10/1997 Yamaguchi et al. ..... 399/274
5,860,050 A * 1/1999 Shimamura et al. .... 399/274 X
6,058,284 A 5/2000 Okano et al. ..... 399/284

FOREIGN PATENT DOCUMENTS

JP 4-118678 4/1992
JP 2632053 4/1997

* cited by examiner

*Primary Examiner*—Fred L Braun
(74) *Attorney, Agent, or Firm*—Fitzpatrick, Cella, Harper & Scinto

(57) ABSTRACT

A developing apparatus includes a developer carrying member carrying thereon a developer having a magnetic substance. The developer carried on the developer carrying member contacts an image holding member in a developing portion. A regulating member abuts against the developer carried on the developer carrying member and regulates the layer thickness of the developer carried on the developer carrying member. A DC electric field forming unit forms a DC electric field between the developer carrying member and the regulating member. The intensity of the electric field formed between the developer carrying member and the regulating member being $10\times10^6$ to $28.3\times10^6$ (V/m).

17 Claims, 9 Drawing Sheets

DEVELOPING APPARATUS WITH A DC ELECTRIC FIELD FORMED BETWEEN A DEVELOPER CARRYING MEMBER AND A DEVELOPER REGULATING MEMBER AND IMAGE FORMING APPARATUS USING THE SAME

BACKGROUND OF THE INVENTION

1. Field of the Invention

This invention relates to a developing apparatus and an image forming apparatus used in image formation by the electrophotographic process.

2. Related Background Art

A developing apparatus adopting a monocomponent contact developing process is known as a developing apparatus used in image formation by the electrophotographic process. This monocomponent contact developing process is such that a toner which is a monocomponent developer is carried on a developing roller as a developer carrying member, and is regulated and formed into a thin toner layer by a toner regulating blade, and a latent image on a photosensitive drum which is an image holding member (or image bearing member) is developed with the developing roller carrying the thin toner layer thereon brought into contact with the surface of the photosensitive drum.

The above-described monocomponent contact developing process is simple in apparatus construction and low in cost, as compared with a two-component developing process using a magnetic carrier besides a toner, and has the merit that it is easy to obtain uniform images low in edge effect, as compared with a noncontact process wherein development is effected with a predetermined spacing between a photosensitive drum and a developing roller, and is generally often used.

In the contact developing process, however, as compared with the noncontact developing process, the frictional contact between the photosensitive drum and the developing roller increases and therefore, as the number of image forming sheets increases, the deterioration of the toner by the frictional contact becomes greater. When the deterioration of the toner occurs, the formation of toner coagulations by the melting and close contact between the contacting surfaces of toner particles, as well as a reduction in the developing property, occurs, and the toner coagulations clog in the abutting surface between the developing roller and the toner regulating blade, and this had led to the problem that streak-like blanks are created in the thin toner layer to thereby bring about streak-like image deterioration (development streaks).

As a method of solving this problem, it is conceivable to burden, for example, a toner binder (binding resin) and prevent the coagulation (cohesion) of the toner, but it is difficult to keep balance between it and fixativeness. Or it is also conceivable to decrease the contact pressure between the photosensitive drum and the developing roller and the set pressure or the like of the toner regulating blade to thereby decrease the load to the toner, but this conversely results in a reduction in the frictional electrification capability for the toner and reduces the developing property, and this also suffers from the problem that it is difficult to keep balance in design.

We have variously investigated such problems to find that as the toner, a magnetic toner comprising a magnetic substance dispensed in a binder is very effective to prevent the development streaks caused by the melting and close contact of the toner. That is, it has been found that the dispersed magnetic substance protrudes on the surfaces of the toner particles and this works as a spacer and prevents the melting of and close contact between the toner particles and prevents the development streaks.

However, when a thin layer of magnetic toner is formed on the developing roller having no magnetic field producing means (magnet) therein, unevenness (coat unevenness) occurs to the thin toner layer and thus, the problem that unevenness appears on an image (unevenness of development) has become liable to arise. Moreover, it has been found that this phenomenon tends to occur more readily as the content of the magnetic substance becomes greater.

As the result of our investigation about this coat unevenness, we have come to think that in the toner, besides a toner charged to a regular polarity, a toner charged to the opposite polarity (reversal toner) is created, and this reversal toner and the regularly charged toner electrostatically attract each other to thereby reduce the fluidity of the toner and this is the cause of the toner coat unevenness.

When as is usual, magnetic field producing means such as a magnet is disposed in the developing roller, it is considered that the magnetic restraining force by the magnetic field producing means is stronger in the influence upon the toner coat than the electrostatic force with the reversal toner and therefore, it is difficult for the toner coat unevenness by the reversal toner to occur.

Japanese Patent Application Laid-Open No. 4-118678 discloses the use of a spherical magnetic toner in the contact developing process. In this publication, it is descried that for the prevention of fog, a magnetic field producing layer is provided in a developing roller to thereby restrain the magnetic toner on the developing roller side, but a method of improving the toner coat unevenness is not described clearly and moreover, the construction of the developing roller of this publication is complicated and results in a considerable increase in cost. Further, the spherical toner is difficult to manufacture stably and therefore is higher in cost than crushed toner.

Japanese Patent No. 2632053 discloses that in a developing apparatus using a nonmagnetic toner which is a monocomponent developer, a bias of ⅔ or less of a discharge starting voltage is applied to a toner regulating blade made of a metal to thereby prevent the electrical attraction of the toner to the regulating member by the action of an electric field and stabilize the toner coat state, thus expediting the frictional electrification of the toner and increasing the electrification among. However, this is a method only for increasing the total amount of toner electrification, and does not clearly describe a method of decreasing the reversal toner.

SUMMARY OF THE INVENTION

It is an object of the present invention to provide a developing apparatus and an image forming apparatus which make it possible to obtain good images by a contact developing method.

It is another object of the present invention to provide a developing apparatus and an image forming apparatus which makes it possible to stably coat a developer carrying member with a toner which is a monocomponent developer without causing streaks and unevenness and use the toner for development, and obtain good images free of streaks and unevenness.

It is still another object of the present invention to provide a developing apparatus comprising:

a developer carrying member carrying thereon a developer having a magnetic substance and carrying the developer, the developer carried on the developer carrying member contacting with an image holding member in a developing portion;

a regulating member for abutting against the developer carried on the developer carrying member and regulating the layer thickness of the developer carried on the developer carrying member; and electric field forming means for forming an electric field between the developer carrying member and the regulating member, the intensity of the electric field formed between the developer carrying member and the regulating member being $10\times10^6$ to $28.3\times10^6$ (V/m).

It is yet still another object of the present invention to provide an image forming apparatus comprising:

an image holding member holding a latent image thereon; and a developing apparatus for developing the latent image, the developing apparatus comprising:

a developer carrying member carrying thereon a developer having a magnetic substance and carrying the developer, the developer carried on the developer carrying member contacting with the image holding member in a developing portion;

a regulating member for abutting against the developer carried on the developer carrying member and regulating the layer thickness of the developer carried on the developer carrying member; and electric field forming means for forming an electric field between the developer carrying member and the regulating member, the intensity of the electric field formed between the developer carrying member and the regulating member being $10\times10^6$ to $28.3\times10^6$ (V/m).

Other objects and features of the present invention will become more fully apparent from the following detailed description when read with reference to the accompanying drawings.

DESCRIPTION OF THE PREFERRED EMBODIMENTS

Some embodiments of the present invention will hereinafter be described in detail with reference to the drawings.

Embodiment 1

Figure 1:
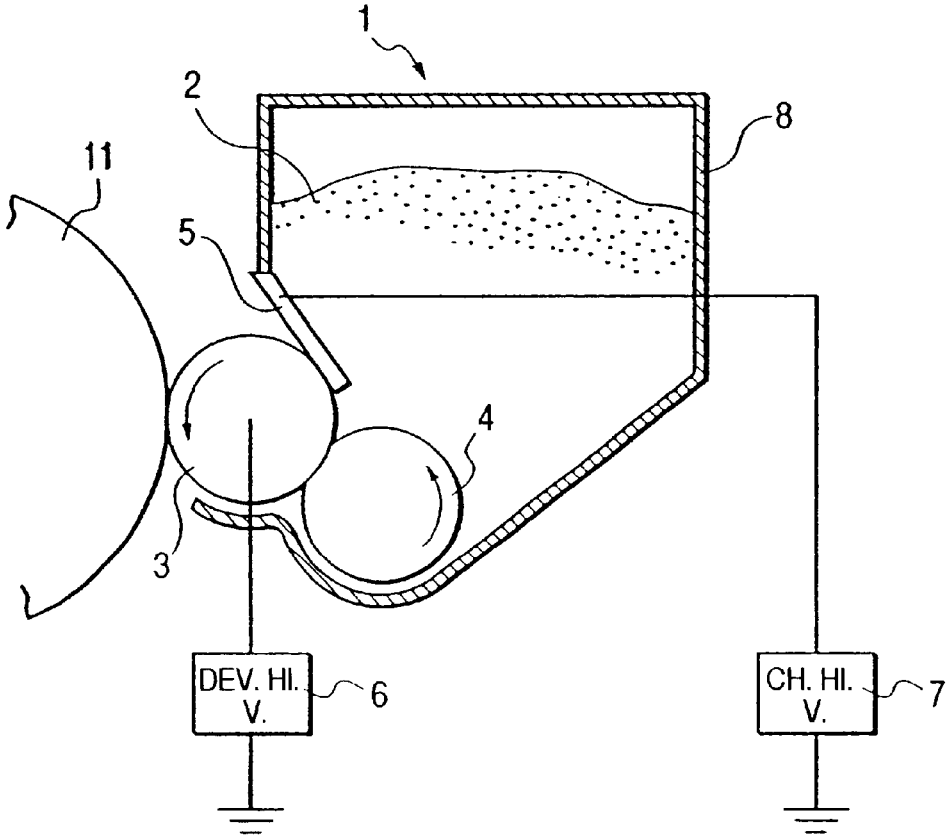
FIG. 1 is a cross-sectional view showing a developing apparatus according to an embodiment of the present invention.
Figure 2:
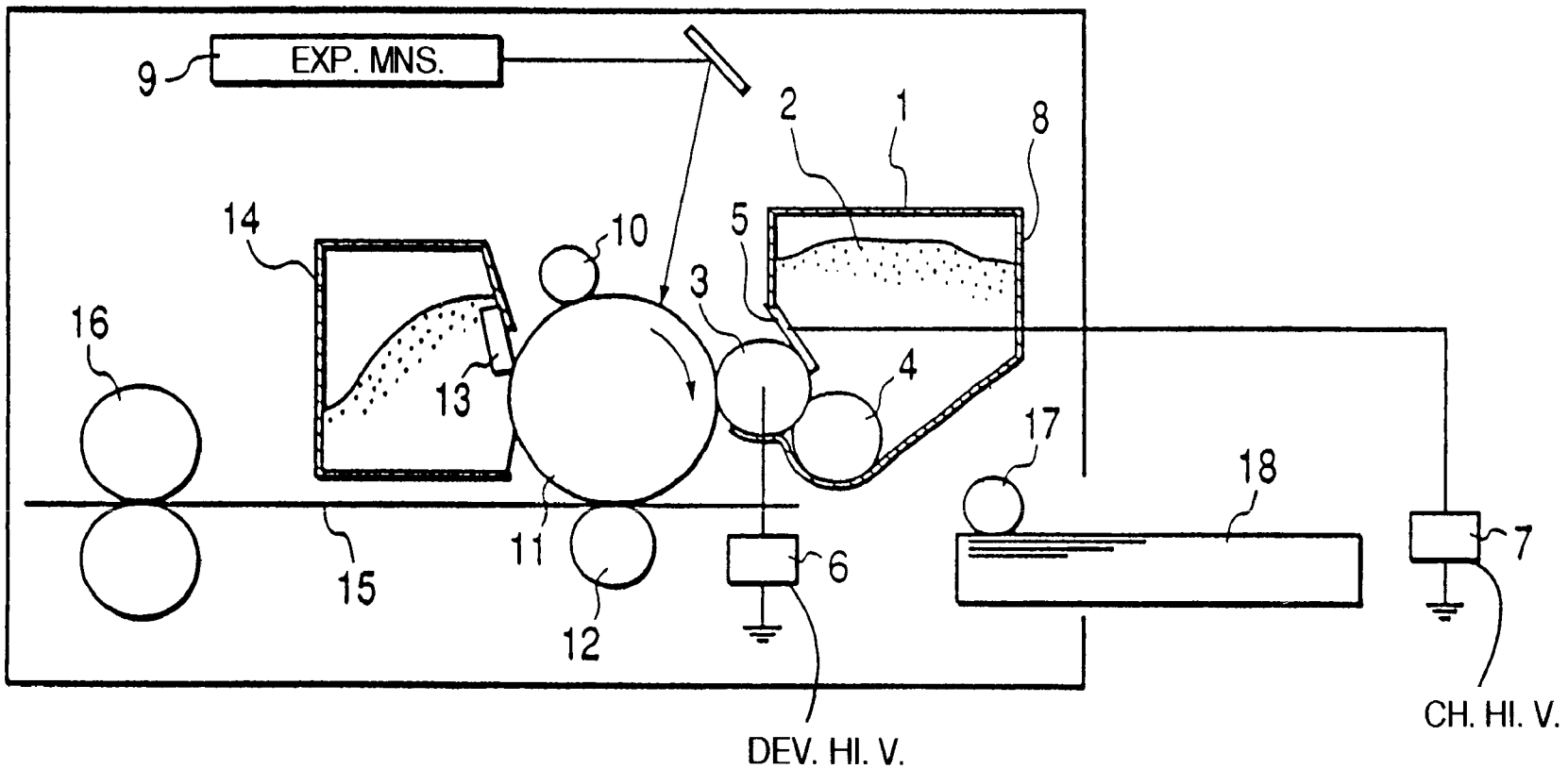
FIG. 2 is a cross-sectional view showing an image forming apparatus provided with the developing apparatus of FIG. 1.

FIG. 1 is a cross-sectional view showing an embodiment of the developing apparatus of the present invention, and FIG. 2 is a cross-sectional view showing an image forming apparatus in which the developing apparatus of FIG. 1 is installed.

The image forming apparatus, as shown in FIG. 2, is provided with a drum-shaped electrophotographic photosensitive member, i.e., a photosensitive drum 11, rotated in the direction of arrow as an image holding member, and the surface of the photosensitive drum 11 is uniformly charged by a charging roller 10, and an image is exposed by exposing means 9, whereby an electrostatic latent image is formed on the surface of the photosensitive drum 11. The electrostatic latent image on the photosensitive drum 11 is developed by a developing apparatus 1 and visualized as a toner image.

The toner image on the photosensitive drum 11 obtained by the development is transferred to a transferring material 15 supplied to the photosensitive drum 11, by a transferring roller 12. The transferring material 15 is contained in a sheet feeding cassette 18, is taken out and fed by a sheet feeding roller 17, and thereafter is sent to the photosensitive drum 11 in synchronism with the toner image on the photosensitive drum 11 by registration rollers, not shown.

The transferring material 15 to which the toner image has been transferred is conveyed to a fixing device 16, where the toner image thereon is fixed by heat or pressure, whereafter it is discharged as a print image out of the image forming apparatus. After the transfer of the toner image, the photosensitive drum 11 has any untransferred toner residual on its surface removed by a blade 13 in a cleaning apparatus 14, whereafter it is subjected to the charging by the charging roller 10 and subsequent image forming steps.

The developing apparatus 1, as shown in FIG. 1, comprises a developing roller 3, an applying roller 4 and a toner regulating blade 5 provided in a developing container 8 containing therein a toner 2 which is a monocomponent developer, and a developing high voltage source 6 and a charging high voltage source 7 are connected to the developing roller 3 and the toner regulating blade 5, respectively.

The developing roller 3 is installed in the opening portion of the developing container 8 for rotation in the direction of arrow, and abuts against the photo-sensitive drum 11 with predetermined abutting pressure. This developing roller 3 is formed of an electrically conductive elastic material, and the resistance value thereof should preferably adjusted to the order of $10^4$–$10_7$ Ωcm, and if the resistance value is lower than this range, the developing roller is liable to be damaged by the leak of an electric current between it and the photosensitive drum 11, and if the resistance value is higher than this range, a reduction in the developing property by the voltage drop in the layer of the elastic material will result.

As the elastic material forming the developing roller 3, mention may be made of rubber such as isoprene rubber, styrene rubber, butadiene rubber, nitrile rubber, chloroprene rubber, butyl rubber, acrylic rubber, urethane rubber, silicone rubber, fluorine rubber, ethylene propylene rubber or epichlorohydrine rubber, and a conductive agent such as carbon, metal powder or a metal oxide dispersed therein is used.

The magnetic toner 2 contained in the developing container 8 is applied onto the developing roller 3 by the applying roller 4, and is carried to a developing portion opposed to the photosensitive drum 11 in accordance with the rotation of the developing roller 3, and has its layer thickness regulated by the toner regulating blade 5 in the course of the carrying, and is formed into a thin toner layer.

The applying roller 4 as developer supplying means is installed on the opposite side from the photosensitive drum 11 and abuts against the latter, and is used while being rotated in the direction of arrow. By the rotaion of the applying roller 4, the application (supply) of the toner 2 to the developing roller 3 and the removal of any residual toner left on the developing roller 3 after the development are effected at a time.

The applying roller 4 comprises an elastic foamed member, and as the material thereof, use is made of rubber such as isoprene rubber, styrene rubber, butadiene rubber, nitrile rubber, chloroprene rubber, butyl rubber, acrylic rubber, urethane rubber, silicone rubber, fluorine rubber, ethylene propylene rubber or epichlorohydrine rubber.

The toner regulating blade 5 is installed downstream of the applying roller 4 with respect to the direction of rotation of the developing roller 3 and in a counter direction to the developing roller 3. This toner regulating blade 5 has at least its portion abutting against the toner on the developing roller 3 made electrically conductive, and in the present embodiment, the whole of the toner regulating blade 5 is formed by a metal plate of e.g. SUS or phosphor bronze or the like. The toner regulating blade 5 abuts against the toner on the developing roller 3 with predetermined abutting pressure so that a proper toner coat layer may be obtained on the toner 2 on the developing roller 3.

According to the present invention, as described above, the charging high voltage (CH. HI. V.) source 7 is provided for the toner regulating blade 5, and during the regulation of the toner 2 on the developing roller 3, applies a predetermined DC voltage as a charging bias to the toner regulating blade 5. This charging bias is provided for causing discharge between the toner regulating blade 5 and the developing roller 3 and effectively giving charges to the toner on the developing roller 3, thereby decreasing reversal toner and preventing the unevenness of the toner coat attributable to the reversal toner.

The toner 2 formed into a thin layer on the developing roller 3 by the regulation by the toner regulating blade 5 comes to the developing portion b the rotation of the developing roller 3, and by the predetermined DC bias (developing bias) applied to the developing roller 3 from the charging high voltage (DEV. HI. V.) source 6 connected through a sliding contact, not shown, the toner 2 adheres to and develops the electrostatic latent image on the photosensitive drum 11.

Figure 3:
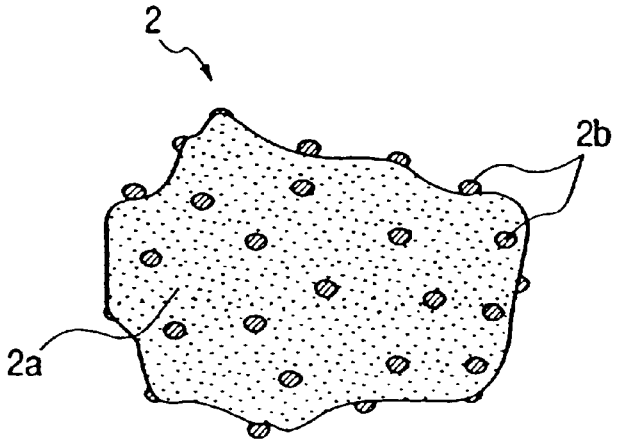
FIG. 3 is a typical view showing a toner which is a monocomponent developer used in the present invention.

Now, in the present embodiment, in order to obtain the effect of preventing toner particles from melting and closely contacting with one another, as shown in FIG. 3, the toner 2 is constructed as a magnetic substance containing toner having magnetic substance particles 2*b* dispersed in the parent body 2*a* comprising binding resin (binder). In the present embodiment, the toner 2 is a negatively chargeable, i.e., negative toner.

For example, 30 to 120 parts by weight of magnetic substance particles, 2 parts by weight of negative electrification control agent which is monoazo iron complex and 3 parts by weight of low molecular weight polypropeylene as wax are melted and mixed with 100 parts by weight of styrene-n-butyl acrylate copolymer, and are cooled, and the obtained mixture is roughly crushed by a hammer mill, and the roughly crushed material is finely crushed by a jet mill, and the finely crushed material is air-classified, whereby the toner 2 is obtained as negatively chargeable amorphous toner cut. The toner 2 is used as a developer with 1.0 part by weight of hydrophobic silica fine powder mixed therewith by a Henschel mixer.

The reason why in the present embodiment, a magnetic substance is contained in the toner 2 is that the coloring effect as a black toner can be obtained and at the same time, as described above, the effect of preventing the toner particles from melting and closely contacting with one another can be obtained. In this magnetic substance containing toner 2, as shown in FIG. 3 described above, the magnetic substance particles 2*b* dispersed in the parent body 2*a* of the toner particles protrudingly exist on the surface of the parent body 2*a* at places, and these protruding magnetic substance particles 2*b* play the role as a spacer and prevent the toner particles from melting and closely contacting with one another.

A description will hereinafter be made of an experiment carried out in the present invention to find the proper values of the amount of magnetic substance in the toner 2 and the applied charging bias to the toner regulating blade 5.

(1) A continuous image forming test was carried out under the following conditions to thereby examine the situation in which developing streaks were created for the amount of magnetic substance in the toner. test environment: temperature 30° C., humidity 80% process speed: 50 mm/sec.

developing roller: made of urethane rubber having carbon dispersed therein, outer diameter 16 mm, rubber thickness 5.0 mm, volume resistivity $10^5$ Ωcm, hardness 40° (asker C hardness), surface roughness Rz (ten-points average roughness) 10 μm, ratio of peripheral speed to the photo-sensitive drum 150%, abutting pressure against the photosensitive drum 30 gf/cm$^2$ developing bias: DC −350 V photosensitive drum: outer diameter 30 mm, dark portion potential −600 V, light portion potential −150 V toner regulating blade: made of an SUS metal plate, thickness 0.1 mm, abutting pressure against the developing roller 15 gf/cm$^2$, applied bias −900 V. (potential difference from the developing roller 550 V)

magnetic substance containing toner: amount of magnetic substance 0 part by weight, 30 parts by weight, 50 parts by weight, 100 parts by weight and 120 parts by weight image formation evaluation mode: 5,000 sheets of originals of A4 size and print rate 4% were continuously subjected to image formation.

As the result, the situation which developing streaks were created was as follows.

For 0 part by weight of magnetic substance (non-magnetic), developing streaks began to be created at about 500 sheets of image formation, and assumed a conspicuous level even for originary character images up to about 2,500 sheets. For 30 parts by weight of magnetic substance, developing streaks began to be created at about 3,000 sheets of image formation, but were slight, and were hardly conspicuous even at 5,000 sheets and were within a range practically free of problem. For 50 or greater parts by weight of magnetic substance, there was little or no creation of developing streaks at the point of time of 5,000 sheets.

From what has been described above, to prevent the creation of developing streaks, it is preferable that the amount of magnetic substance in the magnetic substance containing toner be 30 parts by weight or greater.

(2) A continuous image forming test was carried out under the following conditions to thereby examine the situation in which there occurred uneven development attributable to the toner charge amount Q/M on the developing roller relative to the amount of magnetic substance in the toner and the applied charging bias to the toner regulating blade 5, the fog on the photosensitive drum and the toner coat unevenness.

test environment: temperature 23° C., humidity 60% process speed: 50 mm/sec.

developing roller: made of urethane rubber having carbon dispersed therein, outer diameter 16 mm, rubber thickness 5.0 mm, bolume resistivity $10^5$ Ωcm, hardness 40° (asker C hardness), surface roughness Rz (ten-points average roughness) 10 μm, ratio of peripheral speed to the photo-sensitive drum 150%, abutting pressure against the photosensitive drum 30 gf/cm$^2$ developing bias: DC −350 V photosensitive drum: outer diameter 30 mm, dark portion potential −600 V, light portion potential −150 V toner regulating blade: made of an SUS metal plate, thickness 0.1 mm, abutting pressure against the developing roller 15 gf/cm$^2$, applied bias −350 to −1300 V (potential difference from the developing roller 0 to 950 V)

magnetic substance containing toner: 0 parts by weight, 30 parts by weight, 50 parts by weight, 100 parts by weight and 120 parts by weight of magnetic substance image formation evaluation mode: 5,000 sheets of original of A4 size and print rate 4% were continuously subjected to image formation.

Figure 4:
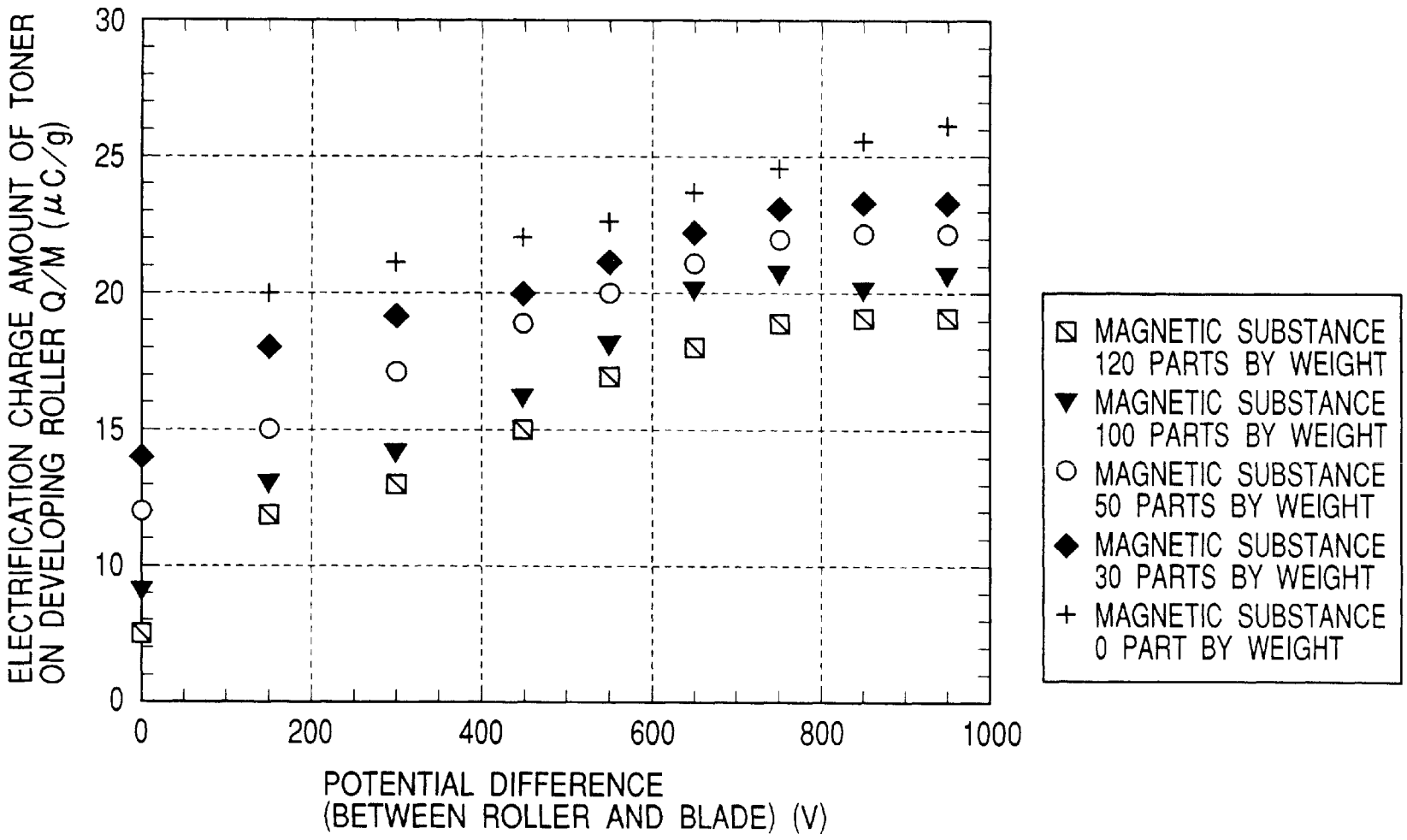
FIG. 4 is a graph showing the relation between the potential difference between the developing roller and toner regulating blade of the developing apparatus of FIG. 1 and the electrification among Q/M of the toner on the developing roller.
Figure 5:
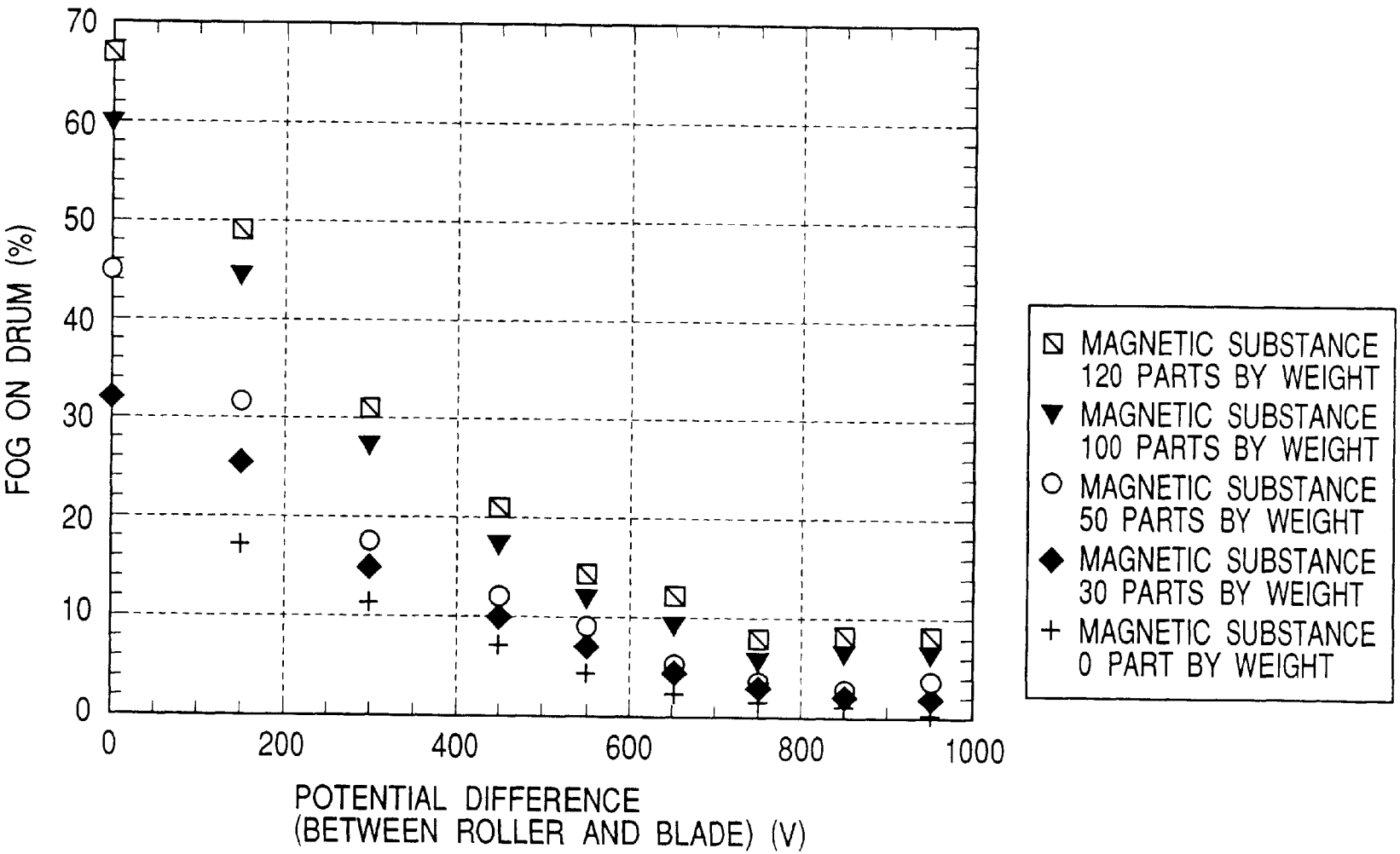
FIG. 5 is a graph showing the relation between the potential difference between the developing roller and toner regulating blade of the developing apparatus of FIG. 1 and the fog on a photosensitive drum.

FIG. 4 is a graph showing the relation between the potential difference between the developing roller 3 and the toner regulating blade 5 and the electrification charge amount Q/M of the toner on the developing roller 3, and FIG. 5 is a graph showing the relation between the potential difference between the developing roller and the toner regulating blade and the fog on the photosensitive drum 11.

From FIG. 4, there is seen the tendency that the greater the potential difference between the developing roller and the toner regulating blade, the more the toner charge amount Q/M increases. This tendency continues to the last in the case of a toner in which the amount of magnetic substance is 0 (nonmagnetic toner) and converges in the vicinity of potential difference 750 V in the case of a toner containing the magnetic substance. This difference in behavior is considered in the toner works like a leak site and at potential difference of 750V or greater, it is in an unstable state in which charge imparting efficiency becomes low.

The mechanism in which the toner charge amount Q/M is increased by giving the potential difference between the developing roller 3 and the regulating blade 5 is considered to be as follows. Up to the potential difference of the order of 300 V before the start of discharge, as described in Japanese Patent No. 2632053, it seems to be the main cause that the frictional electrification efficiency has been improved by the coat stabilizing action of the toner by the prevention of the electro-static attraction of the toner to the toner regulating blade 5. From the range exceeding 300 V, it seems that discharge takes place between the developing roller 3 and the toner regulating blade 5, whereby minus charges are positively supplied to the toner, and minus charges sufficient to restore the polarity of the reversal toner to the original polarity are given.

It is seen that by the effect of the potential difference, as shown in FIG. 5, as the potential difference becomes greater, the more the fog decreases. Since the fog on the drum is the adherence of the toner to nonimage portions, the reversal toner will be chiefly present in it. Accordingly, the charge imparting by discharge is great in the effect of decreasing the reversal toner, and, as the charge is more sufficiently provided the reversal toner is decreased more, and the fog on the drum becomes small.

It is also seen from FIG. 5 that as the amount of magnetic substance in the toner becomes greater, the more fog is produced. The reason for this is considered to be probably that charges of the opposite polarity become liable to be created by the friction between the magnetic substance particles 2*b* present on the surface of the parent body 2*a* the toner particle and the parent body 2*a* and the reversal toner is increased. In the case of the magnetic substance containing toner, no change occurs to the fog at the potential difference of 750 V, and this is also considered to be due to the above-described reduction in the charge imparting efficiency to the toner.

Table 1 below is a table representing the situation in which uneven development occurs. The level of the uneven development is divided into three stages, in which A indicates creation of no unevenness, B dicates creation of some unevenness, and C indicates conspicuous unevenness.

TABLE 1

| (1)<br>(2) | 0 | 30 | 50 | 100 | 120 |
|---|---|---|---|---|---|
| 0 | A | B | C | C | C |
| 150 | A | B | B | C | C |
| 300 | A | A | A | B | B |
| 450 | A | A | A | A | A |
| 500 | A | A | A | A | A |
| 650 | A | A | A | A | A |
| 750 | A | A | A | A | A |
| 850 | A | A | A | B | B |
| 900 | A | B | B | B | B |

(1) amount of magnetic substance (unit: parts by weight)
(2) potential difference (V)

As shown in Table 1, there is the tendency that as the potential difference is increased, uneven development is more improved, but from when 750 V is exceeded, the uneven development conversely begins to be aggravated. Also, there is the tendency that as the amount of magnetic substance in the toner becomes greater, the uneven development is aggravated.

It seems that it is because the reversal toner is decreased by the charge imparting by discharge and there is the improvement in the fluidity of the toner by an electrostatic force that the uneven development is more improved as the potential difference is increased. It is conjectured that the reason why the uneven development begins to be aggravated about when the potential difference exceeds 750 V is that it is an unstable area in which the aforementioned charge leak occurs and the nonuniformity of the electrification charge in the regularly charged toner becomes the unevenness of the developing property and this causes the uneven development.

From the above-described result, to prevent the uneven development, the potential difference between the developing roller 3 and the toner regulating blade 5 should be 300 V or greater and 750 V or less, preferably 300 V or greater and 750 V or less, and more preferably 450 V or greater and 750 V or less. Also, if the amount of magnetic substance in the magnetic substance containing toner exceeds 120 parts by weight, the area in which uneven development can be improved even if a potential difference is given becomes very narrow and therefore, it is preferable that in practice, the amount of magnetic substance be 120 parts by weight or less.

Since the above-described potential difference between the developing roller 3 and the toner regulating blade 5 is the technique of causing discharge to act, it can be replaced by the intensity of the electric field in the abutting portion between the developing roller 3 and the toner regulating blade 5. In the present embodiment, the thickness of the toner layer on the developing roller 3 is of the order of 30 μm and therefore, by the relation that electrical field intensity E=distance d/potential difference, for example, the potential difference 300 to 750 V is $10\times10^6$ to $25\times10^6$ (V/m) in terms of electrical field intensity E.

The aforementioned Japanese Patent No. 2632053 describes the damage by discharge to the developing roller and the toner of a discharge starting voltage or greater. While in the aforedescribed investigation of developing streaks, the evaluation when the potential difference was 550 V was effected, there was no damage to the developing roller by discharge in the case of any toner at the early stage of image formation. However, in the case of the aforedescribed toner not containing the magnetic substance for which conspicuous developing streaks were created at 2,500 sheets of image formation, there was confirmed the damage by discharge on the developing roller in a portion wherein the toner was absent, by the creation of the streaks in the toner coat layer on the developing roller. This is because the pressure resistance of that portion of the developing roller in which the toner was absent was extremely reduced.

As described above, when use is made of the magnetic substance containing toner in which the stability of the toner coat is maintained even by a long-term use, there exists an area which can be used at a discharge starting voltage or greater without suffering from the damage of the developing roller and the toner by discharge.

As described above, in the present embodiment, when the developing roller 3 of the developing apparatus 1 abuts against the photosensitive drum 11 and develops the electrostatic latent image on the photosensitive drum 11 by the toner 2 which is a monocomponent developer, a toner containing a magnetic substance is used as the toner 2 and a charging bias is applied to the toner regulating blade 5 abutting against the developing roller 3, and the intensity of the electric field between the developing roller and the toner regulating blade obtained by the application of the bias is $10\times10^6$ to $28.3\times10^6$ (V/m), and preferably $10\times10^6$ to $25\times10^6$ (V/m), and more preferably $15\times10^6$ to $25\times10^6$ (V/m) and therefore, the occurrence of developing streaks and uneven development by long-term use can be prevented, and images of good quality can be obtained.

Embodiment 2

Figure 6:
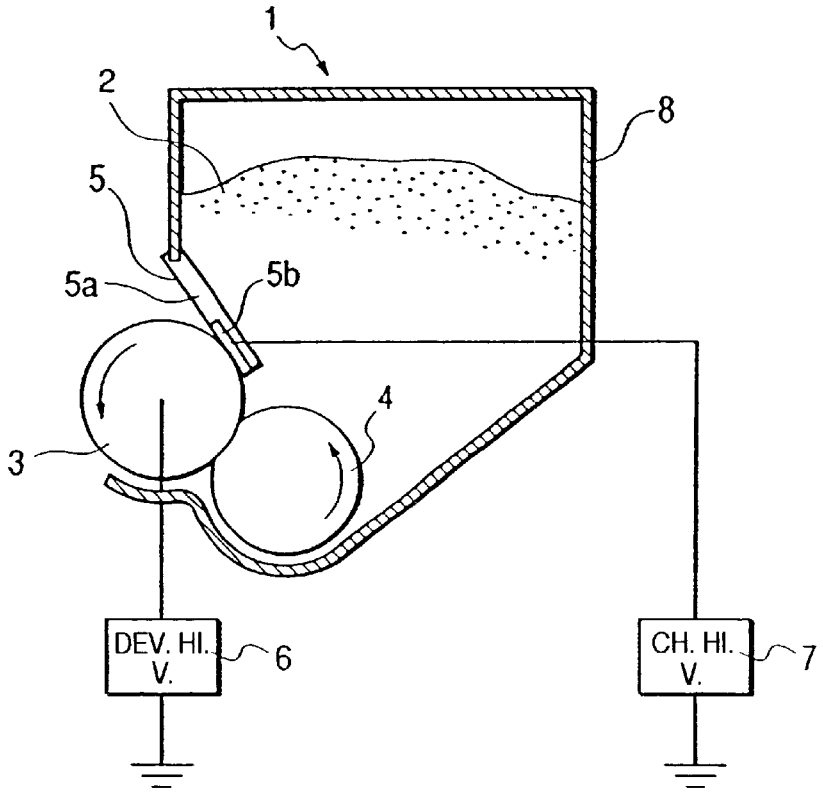
FIG. 6 is a cross-sectional view showing a developing apparatus according to another embodiment of the present invention.

FIG. 6 is a cross sectional view showing a developing apparatus according to another embodiment of the present invention.

This embodiment is such that in the developing apparatus 1 according to Embodiment 1 shown in FIG. 1, the construction of the toner regulating blade 5 is changed as shown in FIG. 6. In the other points, the construction of the developing apparatus of the present embodiment is basically the same as that of the developing apparatus of FIG. 1, and in FIG. 6, the same elements as those in FIG. 1 are given the same reference characters and need not be again described.

The feature of the present embodiment is that only the abutting portion of the toner regulating blade 5 against the developing roller 3 and the vicinity thereof are made into an electrically conducting portion 5*b* to give them electrical conductivity, and the toner regulating blade 5 comprises the electrically conducting portion 5*b* and a holding portion 5*a* holding it. A metal plate, metal foil, electrically conductive resin, electrically conductive rubber or the like can be used as the electrically conducting portion 5*b*. Rubber, resin, a metal or the like is used as the holding portion 5*a*.

As a method of obtaining the abutting pressure of the toner regulating blade 5 against the developing roller 3, there is a method of providing the holding portion 5*a* by an elastic member, and giving it moderate flexure to thereby urge it against the developing roller 3, or a method of providing the holding portion 5*a* by a rigid member, and urging it against the developing roller 3 from the back thereof by a spring which is a discrete member, not shown.

As described above, the toner regulating blade 5 is functionally separated into the electrically conducting portion 5*b* and the holding portion 5*a*, whereby the degree of freedom of design is increased and other merit is also form.

For example, it may be mentioned to construct the toner regulating blade 5 by making the electrically conducting portion 5*b* of an SUS metal plate having a thickness of 0.5 mm, and making the holding portion 5*a* of insulative urethane rubber having a thickness of 1.2 mm, and by thus using rubber smaller in Young's modules metals for the holding portion 5*a*, the fluctuation of the abutting pressure for the irregularity of the thickness and attached position of the holding portion 5*a* can be made small and more stable frictional electrification capacity to the toner can be obtained.

When the toner regulating blade 5 is constructed by making the electrically conducting portion 5*b* of electrically conductive urethane rubber having a thickness of 0.5 mm, and making the holding portion 5*a* of insulative urethane rubber having a thickness of 1.2 mm, the stress to the toner can be greatly reduced by the deformation of the abutting portion by the electrically conducting portion 5*b* being provided by an elastic member. Also, the holding portion 5*a* bringing about the abutting pressure is made of insulative urethane rubber and therefore, an elastic force more stable in respect of permanent deformation or the like than that of electrically conductive rubber can be obtained.

Again in the present embodiment, a toner containing a magnetic substance is used as the toner 2 which is a monocomponent developer, and a charging bias is applied to the toner regulating blade 5 abutting against the developing roller 3, and the intensity of the electric field between the developing roller and the toner regulating blade provided by the application of the bias is confined within the range of $10\times10^6$ to $25\times10^6$ (V/m), whereby the electrostatic latent image on the photosensitive drum 11 can be developed by the toner 2 on the developing roller 3 abutting against the photosensitive drum 11 without causing developing streaks and uneven development by long-term use, thereby obtaining an image of good quality.

Embodiment 3

Figure 7:
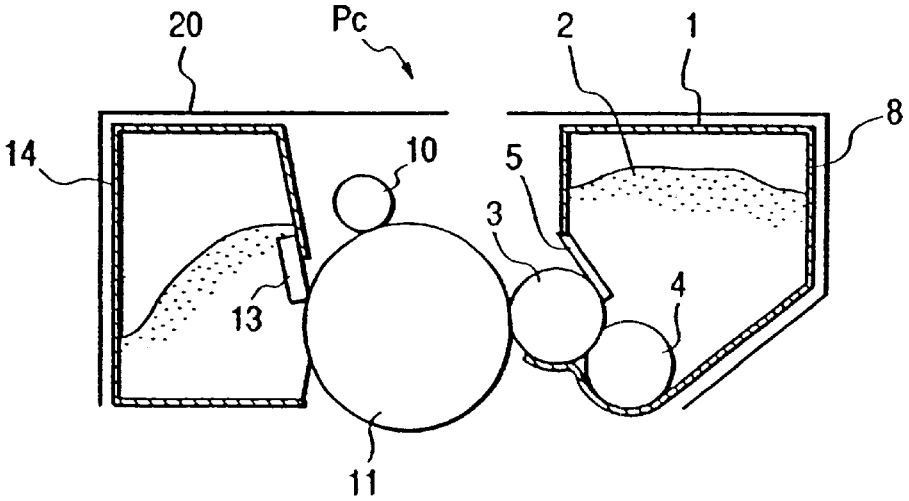
FIG. 7 is a cross-sectional view showing a process cartridge according to still another embodiment of the present invention.
Figure 8:
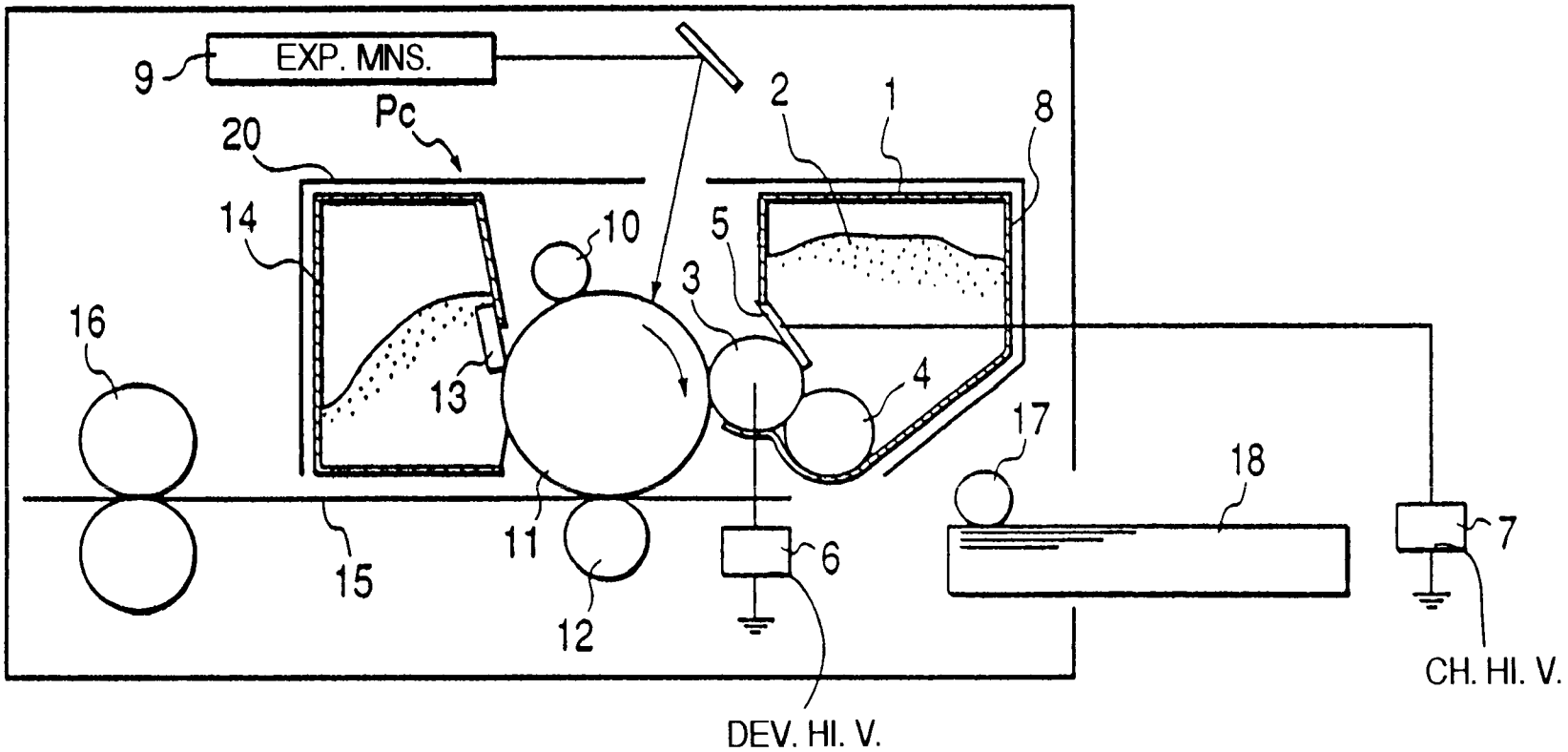
FIG. 8 is a cross-sectional view showing an image forming apparatus provided with the process cartridge of FIG. 7.

FIG. 7 is a cross-sectional view showing a process cartridge according to still another embodiment of the present invention, and FIG. 8 is a cross-sectional view showing an image forming apparatus incorporating the process cartridge of FIG. 7 therein.

As shown in FIG. 7, the process cartridge Pc has a photosensitive drum 11, a charging roller 10, a cleaner apparatus 14 and a developing apparatus 1 incorporated in an exterior package 20, and these are internally detachably mountable with respect to the main body of the image forming apparatus. The developing apparatus according to Embodiment 1 shown in FIG. 1 is used as the developing apparatus 1.

The process cartridge Pc is designed such that when the toner 2 in the developing apparatus I is used up and the like of the developing apparatus has completed its span, the other instruments such as the photosensitive drum 11 also see the end of their lives. Accordingly, the user can always obtain stable images as long as the toner is present in the developing apparatus 1, and moreover, can integrally interchange the developing apparatus 1 as the process cartridge Pc when the life of the developing apparatus 1 expires and therefore, the interchange of the developing apparatus is easy.

According to the present embodiment, in addition to the original advantage of the process cartridge, good images free of the developing streaks and uneven development by long-term use can be obtained as in Embodiment 1.

Embodiment 4

Figure 9:
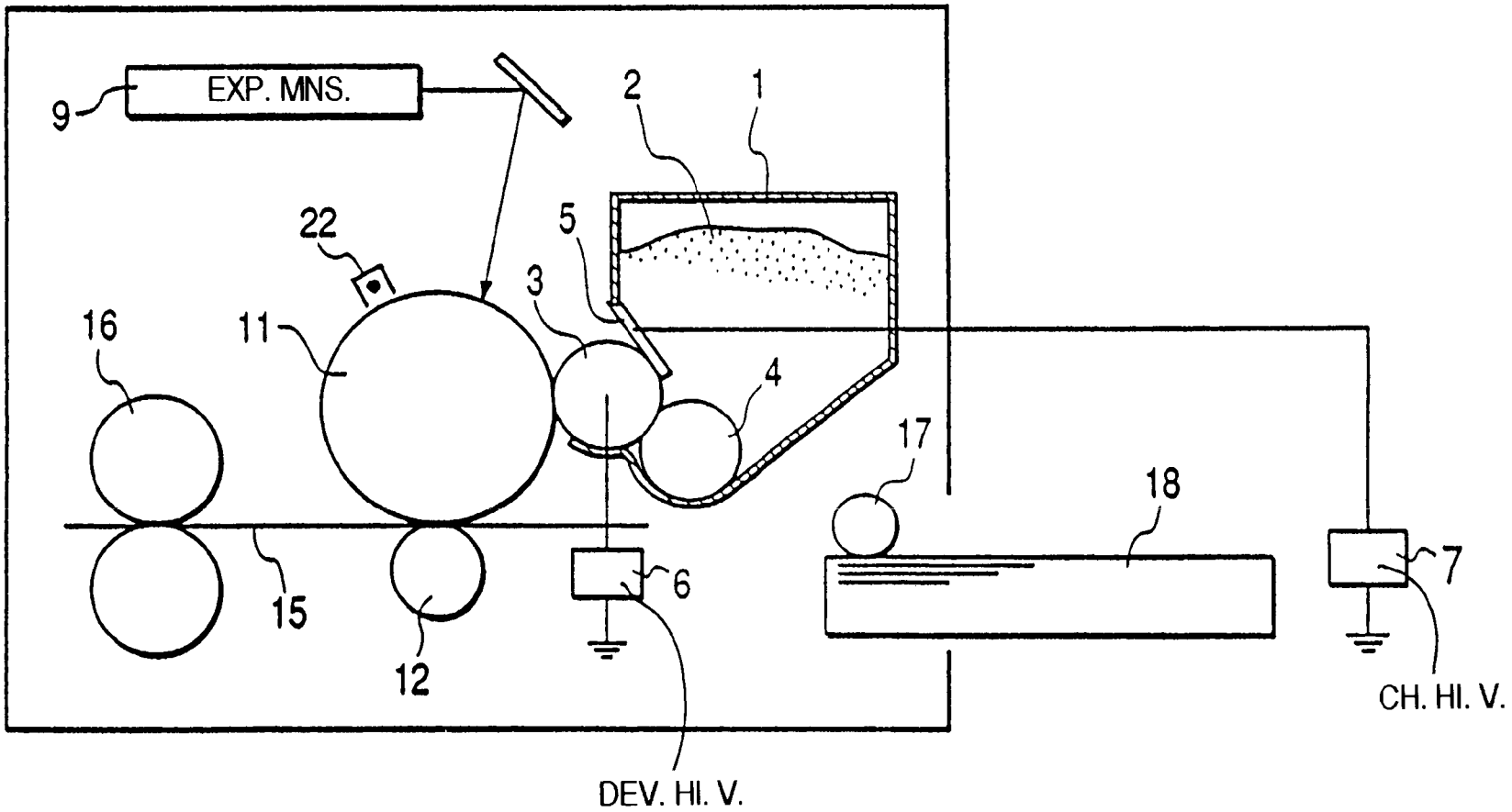
FIG. 9 is a cross-sectional view showing an image forming apparatus according to yet still another embodiment of the present invention.

FIG. 9 is a cross-sectional view showing an image forming apparatus according to yet still another embodiment of the present invention.

The feature of the present invention is that the image forming apparatus is made cleanerless by a cleaning simultaneous with developing system and has no cleaner for the photosensitive drum 11. The developing apparatus according to Embodiment 1 of FIG. 1 is used as the developing apparatus 1. Also, a corona charger 22 is used as the primary charger.

In the other points, the construction of the present embodiment is basically the same as that of the image forming apparatus shown in FIG. 2, and in FIG. 9, the same reference characters as those indicated in FIG. 2 designate the same elements.

Some of untransferred toner residual on the photosensitive drum 11 in the transfer of the toner image to the transferring material 15 by the transferring roller 12 has its charging polarity reversed under the influence of a transferring bias and becomes positively charged reversal toner. However, during the primary charging for the next image, the toner passes the charger 22 and is subjected to negative charging and therefore, reversal toner becomes null in the toner on the photosensitive drum 11, and the collection of the toner into the developing apparatus 1 becomes easy during the development of the next latent image by the developing apparatus 1.

The collection of the untransferred toner by the developing apparatus 1 is accomplished for example, by using −600 V as the dark portion potential (nonimage portion potential) Vd on the photosensitive drum 11, −150 V as the light portion potential (image portion potential) V1, and −350 V as a developing bias Vdc, the negative toner present on the portion of the dark portion potential Vd of the photosensitive drum 11 being shifted to the developing roller 3 in the developing portion of the developing apparatus 1.

The contact development effected by the developing apparatus 1 of the present invention, as compared with the non-contact development, is strong in the action of the electric field and therefore, the collection of the untransferred toner can be effected efficiently, and this is advantageous for providing a cleanerless construction.

In the present embodiment, the corona charger 22 is used as the primary charger, but alternatively, a contact charger such as the charging roller 10 in the image forming apparatus of FIG. 2 may be used, whereby a similar effect can be attained.

According to the present embodiment, the downsizing of the apparatus can be achieved by being cleanerless, and as in Embodiment 1, good images can be obtained without the developing streaks and uneven development by long-term use being caused.

Embodiment 5

Figure 10:
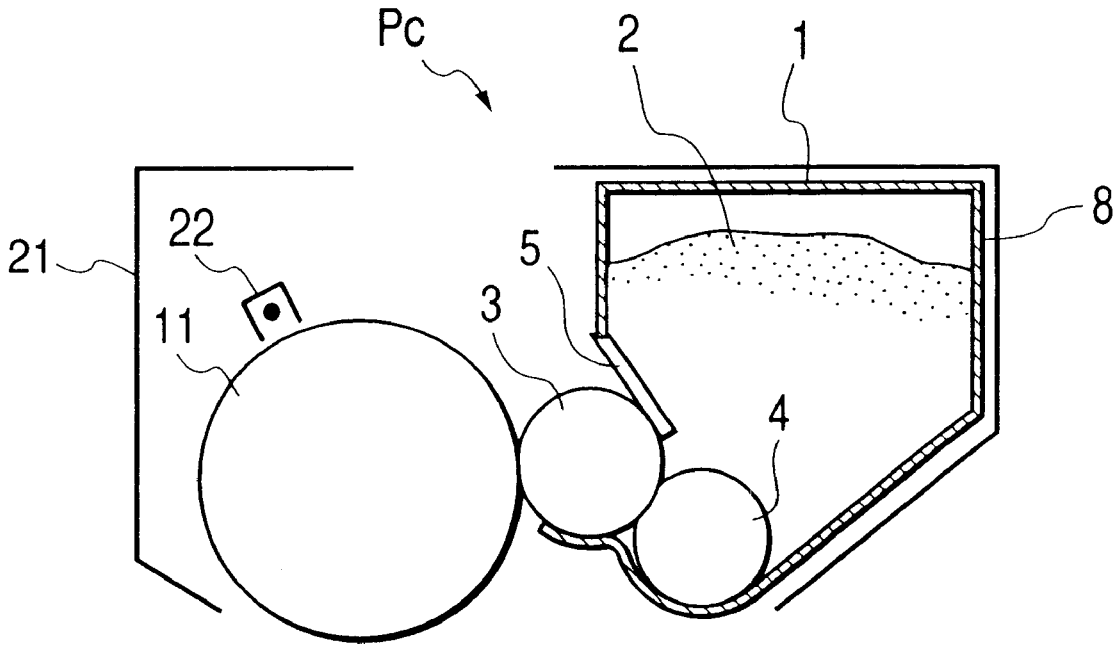
FIG. 10 is a cross-sectional view showing a process cartridge according to a further embodiment of the present invention.
Figure 11:
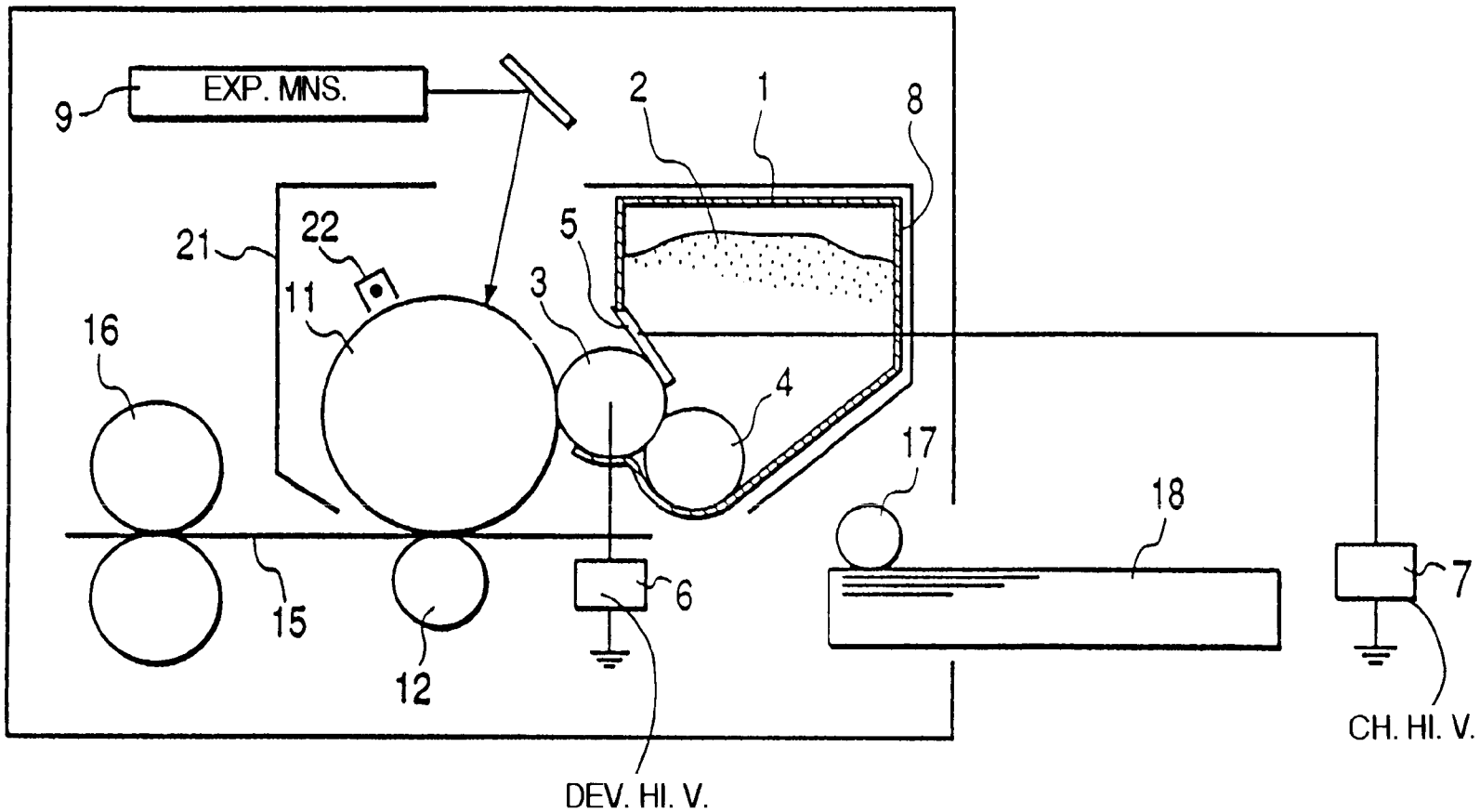
FIG. 11 is a cross-sectional view showing an image forming apparatus provided with the process cartridge of FIG. 10.

FIG. 10 is a cross-sectional view showing a process cartridge according to a further embodiment of the present invention, and FIG. 11 is a cross-sectional view showing an image forming apparatus incorporating the process cartridge of FIG. 10 therein.

This embodiment is characterized in that in the cleanerless image forming apparatus according to Embodiment 4 shown in FIG. 9, the photosensitive drum 11, the corona charger 22 and the developing apparatus 1 thereof are made into a cartridge as shown in FIGS. 10 and 11. In FIGS. 10 and 11, the same reference characters as those in FIG. 9 designate the same members.

The process cartridge Pc incorporates the photosensitive drum 11, the corona charger 22 and the developing apparatus 1 in an exterior package 21, and is detachably mountable with respect to the main body of the image forming apparatus. As in the case of the process cartridge according to Embodiment 3 shown in FIG. 7, the process cartridge Pc according to the present embodiment is designed such that when the toner 2 in the developing apparatus 1 is used up and the life of the developing apparatus has completed its span, the other instruments such as the photosensitive drum 11 also see the end of their lives.

Accordingly, the user can always obtain stable images as long as the toner is present in the developing apparatus 1, and moreover, can integrally interchange the developing apparatus 1 as the process cartridge Pc when the life of the developing apparatus 1 expires and therefore, the interchange of the developing apparatus is easy. Further, by being cleanerless, the image forming apparatus can be made compact.

As described above, according to the present embodiment, as in Embodiment 1, good images free of the developing streaks and uneven development by long-term use can be obtained, and in addition to the original advantage of the process cartridge, the downsizing of the apparatus by being cleanerless can be achieved.

As described above, according to the present embodiment, when the developer carrying member of the developing apparatus abuts against the image holding member and the electrostatic latent image on the image holding member is developed by the toner which is a monocomponent developer on the developer carrying member, a toner containing a magnetic substance is used as the toner, and a charging bias is applied to the toner regulating member abutting against the developer carrying member, and the intensity of the electric field between the developer carrying member and the toner regulating member provided by the application of the bias is confined within the range of $10\times10^6$ to $25\times10^6$ (V/m) and therefore, the toner can be stably applied and used for development without the use of a magnetic restraining force and without causing streaks and unevenness and accordingly, the developing apparatus, and the process cartridge and the image forming apparatus incorporating the developing apparatus therein can be made capable of obtaining good images free of developing streaks and uneven development even during long-term use.

What is claimed is:

1. A developing apparatus comprising:

a developer carrying member carrying thereon a developer having a magnetic substance and carrying the developer, the developer carried on said developer carrying member contacting with an image holding member in a developing portion;

a regulating member for abutting against the developer carried on said developer carrying member and regulating the layer thickness of the developer carried on said developer carrying member; and DC electric field forming means for forming a DC electric field between said developer carrying member and said regulating member, the intensity of the DC electric field formed between said developer carrying member and said regulating member being $10\times10^6$ to $28.3\times10^6$ (V/m).

2. A developing apparatus according to claim 1, further comprising developer supplying means for supplying the developer to said developer carrying member.

3. A developing apparatus according to claim 1, wherein said regulating member has an electrically conductive conducting portion in at least the portion thereof which abuts against the developer carried on said developer carrying member.

4. A developing apparatus according to claim 3, further comprising voltage applying means for applying a DC voltage to said conducting portion.

5. A developing apparatus according to claim 1, wherein the content of said magnetic substance is 120 parts by weight or less.

6. A developing apparatus according to claim 1, wherein the content of said magnetic substance is 50 parts by weight or greater.

7. A developing apparatus according to claim 5, wherein the content of said magnetic substance is 30 parts by weight or greater.

8. A developing apparatus according to claim 1, wherein the intensity of the DC electric field formed between said developer carrying member and said regulating member is $10\times10^5$ to $25\times10^6$ (V/m).

9. A developing apparatus according to claim 1, wherein the intensity of the DC electric field formed between said developer carrying member and said regulating member $15\times10^6$ to $25\times10^6$ (V/m).

10. A developing apparatus according to claim 1, wherein a DC voltage is applied to said developer carrying member.

11. A developing apparatus according to claim 1, which is detachably mountable with respect to the main body of an image forming apparatus as a process cartridge with the image holding member.

12. A developing apparatus according to claim 1, wherein the developer is a monocomponent developer.

13. A developing apparatus according to claim 1, wherein the developer is provided with a toner, the toner being provided with a resin and a magnetic substance exposed to a surface of the resin.

14. A developing apparatus according to claim 1, wherein the DC electric field is formed between said developer carrying member and said regulating member without forming an AC electric field between said developing carrying member and said regulating member.

15. A developing apparatus according to claim 1, wherein an electric potential applied to said regulating member is in a same polarity side as a charging polarity of the developer to a potential to which said developer carrying member is applied.

16. A developing apparatus according to claim 1, wherein said developer carrying member is arranged to contact with said image holding member.

17. An image forming apparatus comprising:

an image holding member holding latent image thereon; and a developing apparatus for developing said latent image, said developing apparatus including:

a developer carrying member carrying thereon a developer having a magnetic substance and carrying the developer, the developer carried on said developer carrying member contacting with an image holding member in a developing portion;

a regulating member for abutting against the developer carried on said developer carrying member and regulating the layer thickness of the developer carried on said developer carrying member; and DC electric field forming means for forming a DC electric field between said developer carrying member and said regulating member, the intensity of the DC electric field formed between said developer carrying member and said regulating member being $10\times10^6$ to $28.3\times10^6$ (V/m).

* * * * *

UNITED STATES PATENT AND TRADEMARK OFFICE

CERTIFICATE OF CORRECTION

PATENT NO. : 6,463,245 B1 
DATED : October 8, 2002
INVENTOR(S) : Koichi Suwa et al.

It is certified that error appears in the above-identified patent and that said Letters Patent is hereby corrected as shown below:

Column 2,
Line 31, "descied" should read -- described --.

Column 4,
Line 63, "adjusted" should read -- be adjusted --; and
Line 63, "$10^4$-$10_7$ Ωcm," should read -- $10^4$ - $10^7$ Ωcm, --.

Column 5,
Line 58, "b" should read -- by --.

Column 6,
Line 30, "toner. test" should read -- toner. ¶test --.

Column 7,
Line 24, "bolume" should read -- volume --.

Column 9,
Line 63, "cross sectional" should read -- cross-sectional --.

Column 10,
Line 19, "other merit is also form." should read -- other merits also result. --.

Column 11,
Line 13, "I" should read -- l --.

Signed and Sealed this

Fourth Day of March, 2003

JAMES E. ROGAN
*Director of the United States Patent and Trademark Office*